US006222506B1

(12) United States Patent
So

(10) Patent No.: US 6,222,506 B1
(45) Date of Patent: Apr. 24, 2001

(54) TRANSMITTING AND RECEIVING ANTENNA FOR ANIMAL TRAINING DEVICES

(76) Inventor: Ho-Yun So, 8-106, Kwangjang Apt., 28, Youido-dong, Yongdungpo-gu, Seoul (KR)

( * ) Notice: Subject to any disclaimer, the term of this patent is extended or adjusted under 35 U.S.C. 154(b) by 0 days.

(21) Appl. No.: 09/533,339

(22) Filed: Mar. 23, 2000

(30) Foreign Application Priority Data

Mar. 26, 1999 (KR) ..... 99-10562

(51) Int. Cl.[7] ..... H01Q 1/36
(52) U.S. Cl. ..... 343/895; 343/873
(58) Field of Search ..... 343/873, 895, 343/745, 715, 900, 906, 702, 788; H01Q 1/36, 9/00

(56) References Cited

U.S. PATENT DOCUMENTS 4,214,247 * 7/1980 Richmond ..... 343/895
6,052,097 * 4/2000 Duncan et al. ..... 343/895

FOREIGN PATENT DOCUMENTS

WO 95/08199 3/1995 (WO) .
WO 95/08853 3/1995 (WO) .

* cited by examiner

*Primary Examiner*—Michael C. Wimer
(74) *Attorney, Agent, or Firm*—Mathews, Collins, Shepherd & Gould

(57) ABSTRACT

A transmitting and receiving antenna for animal training devices is disclosed. In this antenna, a helical coil, made of an enameled wire, is densely wound around a cylindrical bobbin made of Teflon or a ferrite material. Opposite end portions of the helical coil are bonded to the bobbin using a bonding agent, thus being free from undesirably loosening on the bobbin. A core, used for setting a desired specific frequency band of transmitted or received signals, is threaded into an internally-threaded hole of the bobbin. The bobbin is assembled with an internally-threaded bushing of a stud bolt at its externally-threaded part, with one end of the helical coil fixed to the stud bolt through a soldering process. In the above antenna, all the hexagonal body of the stud bolt, the helical coil and the core are covered with a protection cover. Due to the structure of the core movably threaded into the internally-threaded hole of the bobbin, it is easy for a user to precisely and finely set or change a desired frequency band of signals by appropriately rotating the core clockwise or counterclockwise relative to the bobbin. This results in an improved production yield of such antennae. This antenna is also free from using a conventional coil spring, thus preferably having a desired short length and being convenient to a user while carrying or using it.

4 Claims, 3 Drawing Sheets

TRANSMITTING AND RECEIVING ANTENNA FOR ANIMAL TRAINING DEVICES

BACKGROUND OF THE INVENTION

1. Field of the Invention

The present invention relates, in general, to a transmitting and receiving antenna for animal training devices and, more particularly, to a transmitting and receiving antenna attached to a transceiver for animal training devices and used for transmitting and receiving signals of a specific frequency band.

2. Description of the Prior Art

A conventional transmitting and receiving antenna, which is usable with animal training devices, is shown in FIG. 1. As shown in the drawing, the conventional antenna for animal training devices comprises a stud bolt 7, which consists of a hexagonal body 1, an externally-threaded connector 3 and a support projection rod 5. The hexagonal body 1 has a hexagonal cross-section, with the externally-threaded connector 3 extending from one end of the body 1 and the support projection rod 5 extending from the other end of the body 1. A flexible coil spring 9 is fitted over the stud bolt 7 and is fixed to the bolt 7 through a soldering process. A longitudinal rod 11, made of glass fiber, is inserted into the outside end of the coil spring 9. A loading coil 13 is fixed to the coil spring 9 at one end thereof through a soldering process and is coiled around the longitudinal rod 11. The antenna also has a protection cover 15, which is assembled with the hexagonal body 1 of the stud bolt 7 so as to cover both the coil spring 9 and the loading coil 13 wound around the longitudinal rod 11. This protection cover 15 thus protects both the coil spring 9 and the loading coil 13.

In such a conventional transmitting and receiving antenna, it is necessary to use a flexible coil spring 9, which is formed by regularly coiling a copper-plated flexible steel wire at a predetermined pitch, so as to allow the antenna to elastically maintain its desired straight shape while being free from being cut or bent when the antenna is unconsciously caught by an obstacle. Due to such a flexible coil spring 9, it is impossible to reduce the length of the antenna to a desired short length. This finally forces the antenna to have such an awkward length that the antenna is inconvenient to a user while carrying or using it.

In addition, it is necessary to cut a length of the distal end of the loading coil 13, wound around the longitudinal rod 11 made of glass fiber, in order to set a specific frequency band and to allow the antenna to transmit and receive signals of such specific frequency band. It is thus very difficult to precisely or finely control the frequency band of signals to be transmitted and received by the antenna. When an exceeding length of the loading coil 13 is unconsciously cut while setting a specific frequency band of signals to be transmitted and received by the antenna, it is impossible for a resulting antenna to transmit or receive signals of the specific frequency band. This finally reduces the operational reliability of such antennae.

SUMMARY OF THE INVENTION

Accordingly, the present invention has been made keeping in mind the above problems occurring in the prior art, and an object of the present invention is to provide a transmitting and receiving antenna for animal training devices, which is convenient to a user while carrying and using it.

Another object of the present invention is to provide a transmitting and receiving antenna for animal training devices, which is designed to easily set a desired specific frequency band of signals to be transmitted and received by the antenna.

A further object of the present invention is to provide a transmitting and receiving antenna for animal training devices, which is improved in production yield.

Still another object of the present invention is to provide a transmitting and receiving antenna for animal training devices, which has a desired short length.

In order to accomplish the above object, the present invention provides a transmitting and receiving antenna for animal training devices, comprising: a stud bolt consisting of a hexagonal body, with an externally-threaded connector and an internally-threaded bushing provided at opposite ends of the hexagonal body; a cylindrical bobbin having an externally-threaded part at a first end thereof and assembled with the internally-threaded bushing of the stud bolt at the externally-threaded part through a screw-type engagement, with an internally-threaded hole being axially formed on a second end of the bobbin and being used for setting a desired specific frequency band of signals to be transmitted and received by the antenna, and a radial hole being formed on the bobbin at a position around the externally-threaded part in a way such that the radial hole is perpendicular to a central axis of the bobbin; a helical coil inserted into the radial hole of the bobbin at one end thereof so as to be fixed to the stud bolt at the end through a soldering process, the helical coil being regularly, densely and spirally coiled around the bobbin; a core movably engaging with the internally-threaded hole of the bobbin through a screw-type engagement and used for precisely and finely setting the desired specific frequency band of signals; and a protection cover removably assembled with the hexagonal body of the stud bolt so as to cover and protect both the core and the helical coil, the protection cover having a longitudinal cavity designed to receive both the core and the helical coil therein, with a hexagonal fitting mouth communicating with the cavity and being formed at an end of the protection cover so as to be fitted over the hexagonal body of the stud bolt.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
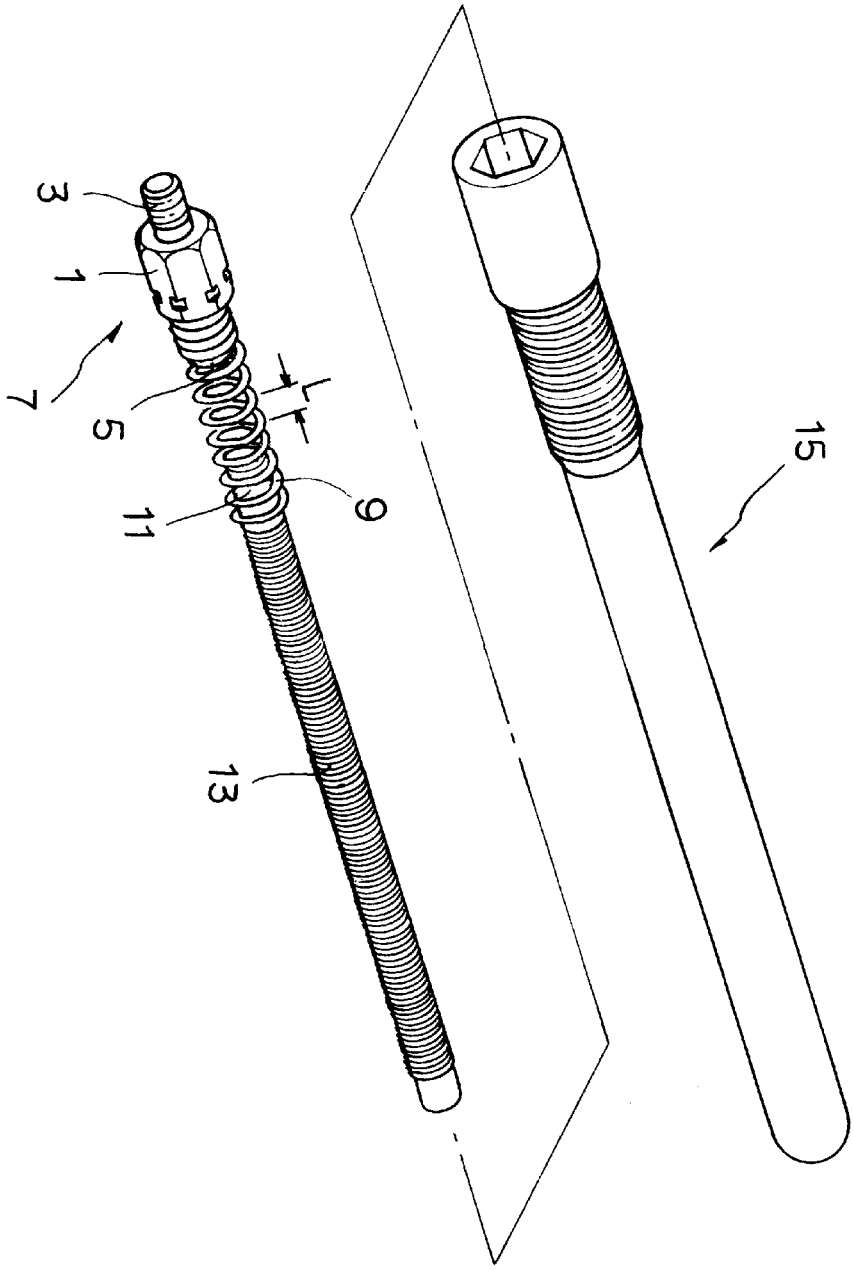
FIG 1 (PRIOR ART)
FIG. 1 is an exploded perspective view of a conventional transmitting and receiving antenna for animal training devices.
Figure 2:
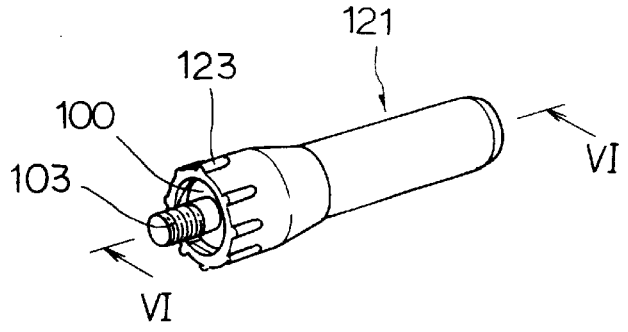
FIG. 2 is a perspective view, showing an appearance of a transmitting and receiving antenna for animal training devices in accordance with the preferred embodiment of the present invention.
Figure 3:
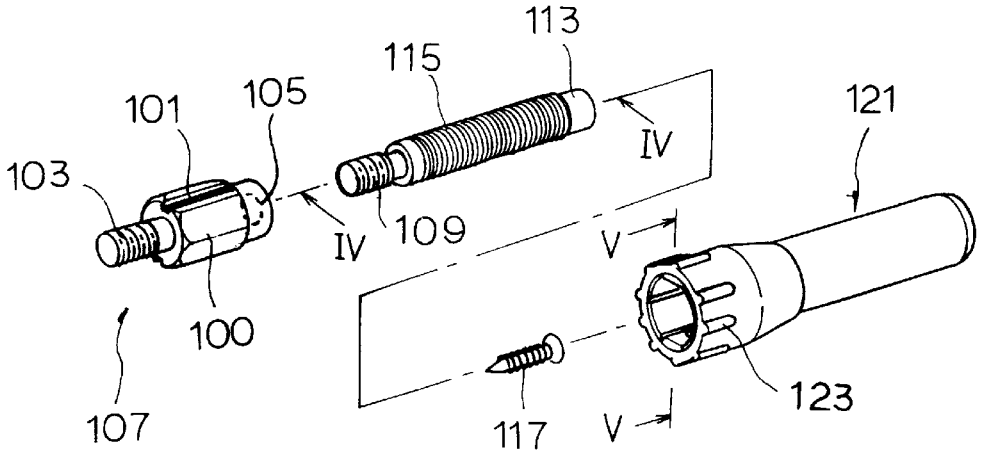
FIG. 3 is an exploded perspective view of the antenna of FIG. 2.
Figure 4:
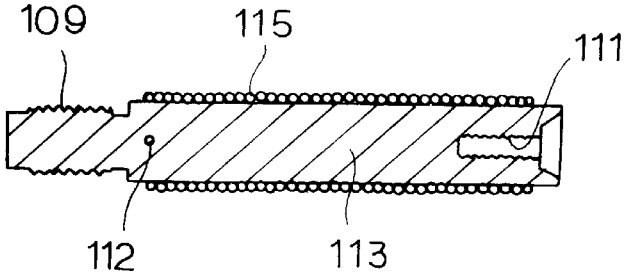
FIG. 4 is a sectional view of the antenna of this invention taken along the line IV—IV of FIG. 3.
Figure 6:
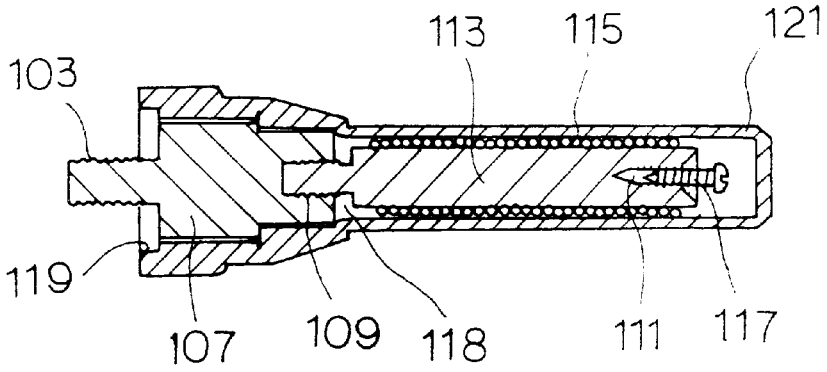
FIG. 6 is a sectional view of the antenna of this invention taken along the line VI—VI of FIG. 2.
Figure 5:
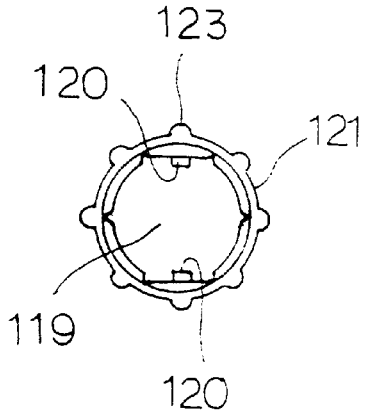
FIG. 5 is a sectional view of the antenna of this invention taken along the line V—V of FIG. 3.

FIG. 2 is a perspective view, showing an appearance of a transmitting and receiving antenna for animal training devices in accordance with the preferred embodiment of this invention. FIG. 3 is an exploded perspective view of the antenna of FIG. 2. FIG. 4 is a sectional view of the antenna of this invention taken along the line IV—IV of FIG. 3. FIG. 5 is a sectional view of the antenna of this invention taken along the line V—V of FIG. 3. FIG. 6 is a sectional view of the antenna of this invention taken along the line VI—VI of FIG. 2.

As shown in FIGS. 2 to 6, the transmitting and receiving antenna for animal training devices according to the preferred embodiment of this invention comprises a stud bolt 107, which consists of a hexagonal body 100 and an externally-threaded connector 103. The hexagonal body 100 has a hexagonal cross-section, with the externally-threaded connector 103 extending from one end of the body 100 and an internally-threaded bushing 105 extending from the other end of the body 100. A cylindrical bobbin 113 is assembled with the internally-threaded bushing 105 of the hexagonal body 100 at its externally-threaded part 109 through a screw-type engagement. The cylindrical bobbin 113 has the externally-threaded part 109 at one end thereof, with an internally-threaded hole 111 being axially formed on the other end of the bobbin 113 and being used for setting a desired specific frequency band of signals to be transmitted and received by the antenna. The above bobbin 113 also has a radial hole 112, which is formed at a position around the externally-threaded part 109 in a way such that the radial hole 112 is perpendicular to the central axis of the bobbin 113. A helical coil 115 is inserted into the radial hole 112 of the bobbin 113 at one end thereof prior to being fixed to the stud bolt 107 through a soldering process. The above helical coil 115 is regularly, densely and spirally coiled around the bobbin 113 so as to reach a position around the end having the internally-threaded hole 111. A core 117 engages with the internally-threaded hole 111 of the bobbin 113 through a screw-type engagement and is used for precisely and finely setting a desired specific frequency band of signals to be transmitted and received by the antenna. The antenna of this invention also has a protection cover 121, which is assembled with the hexagonal body 100 of the stud bolt 107 so as to cover both the core 117 and the helical coil 115 wound around the bobbin 113. This protection cover 121 thus protects both the helical coil 115 and the core 117. The above protection cover 121 has a longitudinal cavity 118 designed to receive both the helical coil 115 and the core 117 therein. A hexagonal fitting mouth 119, communicating with the cavity 118, is formed at the end of the protection cover 121 and is fitted over the hexagonal body 100 of the stud bolt 107.

In the antenna of this invention, the bobbin 113 is preferably made of Teflon or a ferrite material, having a high degree of permeability and a high degree of formability. In the case of a Teflon bobbin 113, it is possible to directly and densely wind the helical coil 115 around the bobbin 113 without interposing an insulator between the bobbin 113 and the coil 115. However, in the case of a ferrite bobbin 113, it is preferable to densely wind the coil 115 around the bobbin 113, with an insulating paper being completely wrapped around the bobbin 113 so as to accomplish a desired electronic insulation effect between the bobbin 113 and the coil 115. Of course, it should be understood that it is possible to wind the coil 115 around such a ferrite bobbin 113 without wrapping an insulating paper on the bobbin 113.

As shown in FIG. 4, it is preferable to set the number of turns of the helical coil 115 wound around the bobbin 113 to 200 to 250 turns, which allows the coil 115 to be densely coiled with each turn of the coil 115 to be brought into contact with neighboring turns. In the present invention, an enameled wire is preferably used as the material of the helical coil 115. Of course, it should be understood that the number of turns of the helical coil 115 is changed in accordance with a desired frequency band of signals to be transmitted and received by the antenna.

The above protection cover 121 is made through a plastic injection molding process. In order to accomplish a firm engagement of the cover 121 with the hexagonal body 100 of the stud bolt 107, two longitudinal fitting grooves 101 are axially formed on the external surface of the body 100 at diametrically opposite positions, with two longitudinal fitting rails 120 being axially formed on the internal surface of the hexagonal fitting mouth 119 of the cover 121 at diametrically opposite positions and engaging with the two fitting grooves 101. A plurality of axial projections 123 are regularly formed on the external surface of the cover 121 at a portion around the mouth 119, allowing a user to easily rotate the stud bolt 107 when the antenna is integrated with a transceiver (not shown) by bringing the externally-threaded connector 103 of the stud bolt 107 into a screw-type engagement with an internally-threaded part of the transceiver.

In the present invention, it is preferable to use a tapping screw or a screw bolt, made of stainless steel or ferrite, as the core 117.

The process of producing the above antenna and operational effect of the antenna will be described hereinbelow.

In order to produce an antenna of this invention, a cylindrical bobbin 113 is fixed to the winding shaft of a winder (not shown) prior to inserting one end of an enameled wire into the radial hole 112, which is formed on the bobbin 113 at a position around the externally-threaded part 109. Thereafter, the winder is turned on, thus allowing the enameled wire to be regularly, densely and spirally coiled around the bobbin 113 and to form a single-layered helical coil 115 as shown in FIG. 4.

In order to prevent the helical coil 115 from being undesirably loosened on the bobbin 113, an instantaneous bonding agent is dropped onto an area of 1–5 mm width at each end of the coil 115, thus instantaneously bonding opposite end areas of the coil 115 to the bobbin 113.

Thereafter, the externally-threaded part 109 of the bobbin 113 is brought into screw-type engagement with the internally-threaded bushing 105 of the stud bolt 107, thus assembling the bobbin 113 with the stud bolt 107 into a single structure. After assembling the bobbin 113 with the stud bolt 107, the end of the helical coil 115, inserted into the radial hole 112 of the bobbin 113, is fixed to the stud bolt 107 through a soldering process. In such a case, it is preferable to apply a bonding agent to the junction between the externally-threaded part 109 of the bobbin 113 and the internally-threaded bushing 105 of the stud bolt 107 while assembling the bobbin 113 with the stud bolt 107, thus accomplishing a firm engagement between the two threaded parts 105 and 109.

Thereafter, a core 117 is appropriately threaded into the internally-threaded hole 111 of the bobbin 113 so as to set a specific frequency band of signals to be transmitted and received by the antenna. After setting a desired specific frequency band of signals by controllably threading the core 117 into the hole 111 of the bobbin 113, the protection cover 121 engages with the stud bolt 107 by fitting the hexagonal fitting mouth 119 of the cover 121 over the hexagonal body 100 of the stud bolt 107. When the hexagonal fitting mouth 119 of the cover 121 is fitted over the hexagonal body 100 of the stud bolt 107, the two longitudinal fitting rails 120 of the hexagonal fitting mouth 119 engage with the two fitting grooves 101 of the hexagonal body 100, thus accomplishing a firm engagement of the cover 121 with the stud bolt 107.

In such a case, the axial projections 123 are regularly formed on the external surface of the protection cover 121, and so it is possible to easily insert the hexagonal body 100 of the stud bolt 107 into the mouth 119 of the cover 121. The above axial projections 123 of the protection cover 121 also allow a user to easily rotate the stud bolt 107 when the resulting antenna is integrated with a transceiver (not shown) by bringing the externally-threaded connector 103 of the stud bolt 107 into a screw-type engagement with an internally-threaded part of the transceiver.

When it is necessary to change the preset frequency band of the antenna, the protection cover 121 is primarily removed from the stud bolt 107. Thereafter, the core 117 is appropriately rotated clockwise or counterclockwise relative to the bobbin 113 until a newly desired frequency band is accomplished. Therefore, it is very easy for a user of this antenna to set or change the frequency band of signals to be transmitted or received by the antenna.

The transmitting and receiving antenna for animal training devices according to this invention is thus free from using a conventional coil spring, but uses a bobbin 113 made of Teflon or a ferrite material, which has a high degree of permeability and a high degree of formability. Therefore, it is possible to preferably reduce the length of the antenna, and so the antenna of this invention is very convenient to a user while carrying or using it. In addition, a desired frequency band of signals to be transmitted and received by the antenna is easily and precisely set by appropriately rotating the core 117 relative to the internally-threaded hole 111 of the bobbin 113. This finally allows resulting antennae to have improved and uniform quality in addition to an improved operational reliability. The production yield of such antennae is thus remarkably improved.

As described above, the present invention provides a transmitting and receiving antenna for animal training devices. In this antenna, a helical coil, made of enameled wire, is densely wound around a cylindrical bobbin made of Teflon or a ferrite material. Opposite end portions of the above helical coil are bonded to the bobbin using a bonding agent so as to be free from being undesirably loosened from the bobbin. A core, used for allowing a user to control a desired specific frequency band of signals to be transmitted and received by the antenna, is movably threaded into an internally-threaded hole formed at the end of the bobbin. The above bobbin is assembled with an internally-threaded bushing of a stud bolt at its externally-threaded part through a screw-type engagement. One end of the helical coil is fixed to the stud bolt through a soldering process. In the antenna of this invention, all the hexagonal body of the stud bolt, the helical coil and the core are covered with a protection cover, thus being protected from external impact. Due to the structure of the core movably threaded into the internally-threaded hole of the bobbin, it is easy for a user to precisely and finely set or change a desired frequency band of signals by appropriately rotating the core relative to the internally-threaded hole of the bobbin. This also results in an improved production yield of such antennae. The antenna of this invention is free from using a conventional coil spring, thus preferably having a desired short length. This antenna is thus convenient to a user while carrying or using it.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A transmitting and receiving antenna for animal training devices, comprising:

a stud bolt consisting of a hexagonal body, with an externally-threaded connector and an internally-threaded bushing provided at opposite ends of said hexagonal body;

a cylindrical bobbin having an externally-threaded part at a first end thereof and assembled with said internally-threaded bushing of the stud bolt at said externally-threaded part through a screw-type engagement, with an internally-threaded hole being axially formed on a second end of said bobbin and being used for setting a desired specific frequency band of signals to be transmitted and received by the antenna, and a radial hole being formed on the bobbin at a position around said externally-threaded part in a way such that the radial hole is perpendicular to a central axis of the bobbin;

a helical coil inserted into said radial hole of the bobbin at one end thereof so as to be fixed to the stud bolt at said end through a soldering process, said helical coil being regularly, densely and spirally coiled around the bobbin;

a core movably engaging with said internally-threaded hole of the bobbin through a screw-type engagement and used for precisely and finely setting the desired specific frequency band of signals; and a protection cover removably assembled with the hexagonal body of the stud bolt so as to cover and protect both the core and the helical coil, said protection cover having a longitudinal cavity designed to receive both the core and the helical coil therein, with a hexagonal fitting mouth communicating with said cavity and being formed at an end of the protection cover so as to be fitted over the hexagonal body of the stud bolt.

2. The transmitting and receiving antenna according to claim 1, wherein said core is a metal screw bolt.

3. The transmitting and receiving antenna according to claim 1, wherein said bobbin is made of Teflon or a ferrite material, individually having a high degree of permeability and a high degree of formability.

4. The transmitting and receiving antenna according to claim 1, wherein said helical coil is made of an enameled wire.

* * * * *